US005425442A

United States Patent [19]

Lichti

[11] Patent Number: 5,425,442

[45] Date of Patent: Jun. 20, 1995

[54] DRIVE SYSTEM FOR A VERTICAL STORAGE CONVEYOR

[75] Inventor: Robert Lichti, Lake Almanor, Calif.

[73] Assignee: Howard M. Lawn, North Miami Beach, Fla.

[21] Appl. No.: 201,540

[22] Filed: Feb. 25, 1994

Related U.S. Application Data

[63] Continuation-in-part of Ser. No. 4,081, Jan. 13, 1993, Pat. No. 5,374,149.

[51] Int. Cl.[6] ..... B65G 17/16

[52] U.S. Cl. ..... 198/797; 198/833; 414/248; 414/251

[58] Field of Search ..... 198/797, 798, 800, 832.3, 198/833; 414/247, 248, 249, 251

[56] References Cited

U.S. PATENT DOCUMENTS

| | | | |
|---|---|---|---|
| 2,089,047 | 5/1933 | Zrna . | |
| 3,278,052 | 10/1966 | Lichti . | |
| 3,424,321 | 1/1969 | Lichti . | |
| 3,547,281 | 12/1970 | Lichti . | |
| 3,656,608 | 4/1972 | Lichti . | |
| 4,224,624 | 9/1980 | Evans . | |
| 4,275,979 | 6/1981 | Lichti et al. . | |
| 4,290,724 | 9/1981 | Lichti et al. . | |
| 4,826,384 | 5/1989 | Okura et al. . | |
| 5,273,392 | 12/1993 | Bernard et al. | 198/800 |
| 5,374,149 | 12/1994 | Lichti | 198/800 |

FOREIGN PATENT DOCUMENTS

| | | |
|---|---|---|
| 1604815 | 5/1972 | France . |
| 53-85074 | 7/1978 | Japan . |
| 53-85076 | 7/1978 | Japan . |
| 1178679 | 7/1989 | Japan . |
| 247474 | 2/1990 | Japan . |

*Primary Examiner*—Joseph E. Valenza
*Attorney, Agent, or Firm*—Morgan & Finnegan

[57] ABSTRACT

A vertical conveyor is disclosed having a frame with a first and second vertical frame section spaced apart but supportingly connected to each other. Load supports having first and second ends are conveyed around a looped path. Each load support is movably mounted at the first and second ends to first and second frame sections. A pickup chain assembly has a pickup drive chain, an upper drive sprocket driven by the motor wherein a substantial amount of the load exerted by the supports against the pickup chain assembly is imported against the upper drive sprocket. An idler sprocket is aligned below the drive sprocket and has a smaller diameter than the drive sprocket. The pickup drive chains include a plurality of pickups pivotally mounted thereto which engage transverse axles mounted at the end of compression links of a compression chain assembly. The load supports are mounted on the compression chain assembly. A motor simultaneously drives the first and second pickup chain assemblies which in turn drive the compression chains and move the supports up and down.

10 Claims, 11 Drawing Sheets

DRIVE SYSTEM FOR A VERTICAL STORAGE CONVEYOR

This application is a continuation in part of application Ser. No. 08/004,081 filed 13 Jan. 1993 now U.S. Pat. No. 5,374,149, by the same inventor, which application is incorporated by reference into this application in its entirety.

FIELD OF THE INVENTION

The present invention relates in general to a conveyor system, and in particular relates to a new and improved drive system for a conveyed pan in a vertical storage conveyor.

BACKGROUND OF THE INVENTION

The present invention is an improvement to a vertical storage conveyor type apparatus used for parking or storing automobiles and the like. Prior art examples include U.S. Pat. Nos. 3,424,321; 3,547,281; and 3,656,608, the entire disclosure of each of which is incorporated herein by reference.

The vertical conveyors have two independent, vertical frames, as well as beams and struts connecting the frames, and an independent conveyor assembly connected to each frame. Each vertical conveyor has an endless compression chain formed of a plurality of rigid, compression links pivotally connected together with joint pins to form an endless vertical chain. Rollers or wheels are mounted at each end of the joint pin and are constrained to move only within a vertical guide channel.

A plurality of pickup members are journalled in a spaced apart generally upright, but slightly pivotal relationship, and attached to a pickup drive chain. The compression members engage a compression link joint pin of the pickup chain when the chain is rotated by the motor. The pickup members are guided by a stationary cam surface and engage the pins to lift the compression links. In the prior art patents, the bottom sprocket was the drive sprocket with the load carried by the upper sprocket creating slack in the non-driven side of the pickup chain.

In some of the prior art designs, such as manufactured by some Japanese companies, a motor for driving the conveyors is located near the top of the device. It has been found that the motor is better placed in the lower vertical half of the device.

Additionally, some prior art designs did not allow smooth movement of moving parts. For example, in one design the attachment and support for the top transfer guide to the top of the fixed tower structure included vertical captive slides with Bellville washers providing a friction force to counteract the vertical weight of the top transfer guide. This arrangement did not allow sufficient adjustment or smoothness of movement. It would be desirable to dampen the motion of the guide.

In some prior art designs, the bottom transfer guide was supported by tie rods to control the lateral movement. A spring support offset the vertical weight of the transfer guide. As the pans rotated through the bottom transfer guide, there was vertical movement of the guide. Without any means for damping, a vibration and jerking motion occurred. It would therefore be desirable to dampen the motion of the guide.

Also, when the tower was stopped, a service brake prevented rotation of the compression chains. A positive locking means is therefore desirable to prevent movement of the compression chain while people are ingressing and egressing the bottom area of the tower.

In the copending parent application, the frame has a vertically extending first frame section and a vertically extending second frame section spaced apart from the first frame section. Each load support has a first and second end and is capable of holding a load to be conveyed in a loop. Each load support is movably mounted at the first and second ends to the first and second frame sections. As one support is conveyed upwardly, another support is conveyed downwardly so that the supports pass one another at a predetermined, spaced apart horizontal distance which defines a support spacing.

A first conveyor is mounted to the first frame section for conveying a first end of the supports. A second conveyor is mounted to the second frame section for conveying a second end of the supports. A mounting member extends in the support spacing, and includes a motor mounted thereto. The motor drives the first and second conveyors. The motor includes a first drive shaft which connects the motor to the first conveyor and a second drive shaft which connects the motor to the second conveyor.

In accordance with the invention disclosed in the copending parent application, first and second frame sections are supportingly connected to each other with a plurality of connecting members rigidly attached at respective ends thereof to first and second frame sections. One of the connecting members extends between first and second frame sections in the support spacing. The mounting member is mounted to one connecting member between first and second frame sections. The motor mounting member is suspended from one connecting member substantially centrally between the frame sections.

Although the motor mounting point between the frame sections and to the frame sections is advantageous, it is also desirable to further improve the drive transmission, pickups and associated equipment. For example, it is desirable to reduce the tendency for the pickup chain to stretch and have slack during a quick reversal in rotation such as occurs in prior art towers where the lower sprocket was driven. When the pickup chain was reversed, the claim tightens quickly, creating great forces. It would also be desirable to ensure that the pickup arms are oriented so that each arm engage respective shafts of the compression chain in a more exact manner. Additionally, it would be desirable if each pickup arm could be disassembled from the unit without disturbing the orientation of the pickup and compression chains.

SUMMARY OF THE INVENTION

The present invention is advantageous because the chain slack produced in prior art conveyors is now minimized so that any reversing action of the conveyor will not produce large stresses on the pickup chain. Additionally, the construction of the pickup using the two piece general construction allows ready disassembly of the pickup arms from the pickup chain without disturbing the pickup chain and the compression chain. Other advantages will be apparent from the summary and detailed description which follows.

In accordance with the present invention, the vertical conveyor has a frame with a first vertical frame section and a second vertical frame section spaced apart from, but supportingly connected to each other. A plurality of load supports each have first and second ends that are capable of holding a load to be conveyed around an endless loop. Each support is movably mounted at its first and second ends to first and second frame sections. As one support is conveyed upwardly, another support is conveyed downwardly so that the supports pass one another at a predetermined, spaced apart horizontal distance which defines a support spacing.

First and second conveying means mounted to the first and second frame sections for conveying a first and second end of each support. The first and second conveying means each comprises a drive chain assembly and means interconnecting the drive chain assembly with each of the supports. A motor simultaneously drives the first and second drive chain assemblies.

In one aspect of the invention, the first and second drive chain assemblies each comprises a pickup drive chain which drives a compression chain supporting the load supports, and an upper drive sprocket of the pickup drive chain driven by a motor wherein a substantial amount of the load exerted by the supports against the pickup drive chain is imparted against the upper drive sprocket. An idler sprocket is aligned below the drive sprocket and has a smaller diameter than the drive sprocket. Thus, the slack produced in the pickup drive chain is minimized such as occurs during reversing motion of the conveyor.

In one aspect of the invention, a plurality of pickup arms are pivotally connected to the pickup drive chain such that the pickup arms engage and drive the compression chain so as to move the load supports. The pickups are pivotally mounted offset on the pickup chain to aid in engagement of the pickups with the compression chain. The compression chain includes an endless roller chain comprised of interconnecting, elongate compression links and transverse axles mounted at each end of the compression links such that the pickup arms engage the axles for pushing the compression links upward. The offset mounting of the pickups enables receiving notches on the pickups to engage the axles as the chain moves in its lower portion of the loop.

In one aspect of the invention, the load supports include load support mounting arms, which are pivotally mounted to the compression links. A mounting member extends in the support spacing. The motor is mounted to the mounting member. A connecting member supportingly connects the first and second frame sections. The motor mounting member is suspended from the connecting member substantially centrally between the frame members.

In still another aspect of the invention, the pickup chain comprises two spaced roller chains. Each through-pin connects the roller chains. The pickups are pivotally connected to the roller chain between the pickups. The pickup chain also includes a link, and a link pin interconnecting the link. The through-pins are offset from the link pins. The pickups comprise an upper head portion and a smaller lower bifurcated tail portion. The upper head portion includes opposing receiving notches for engaging the through-pins of the compression chain.

In one aspect of the invention, as a pan traverses through the top transfer guide, the guide moves upward and then returns to its original height. In addition, as the compression chain links shorten over the life of the conveyor, the reference starting point for the top transfer guide moves slightly downward.

As the pan traverses through the bottom transfer guide, a vibration develops due to a lack of dampening of the guide motion which moves downward from a reference point and returns. The present invention provides for a vertical floating motion with a dampening effect.

In still another aspect of the invention, a positive locking device prevents movement of the compression chain while the rotational movement of the pan is at rest. The locking device is capable of transferring any load imbalance to the frame structure.

BRIEF DESCRIPTION OF THE DRAWINGS

The foregoing advantages of the present invention will be appreciated more fully from the following description, with reference to the accompanying drawings, in which.

DETAILED DESCRIPTION OF THE PREFERRED EMBODIMENT

Figure 1:
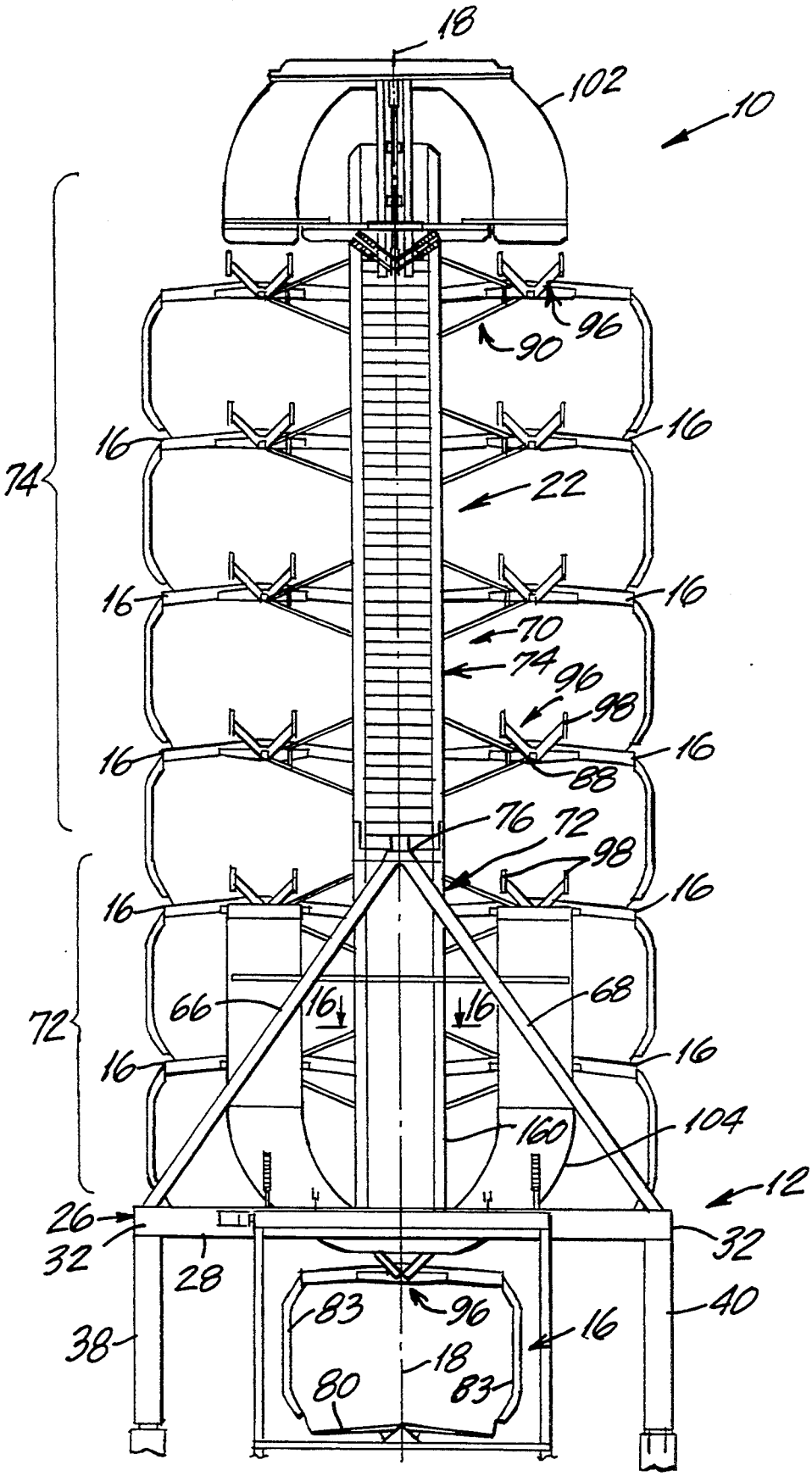
FIG. 1 is an front end elevation view of a vertical conveyor according to one embodiment of the present invention.
Figure 2:
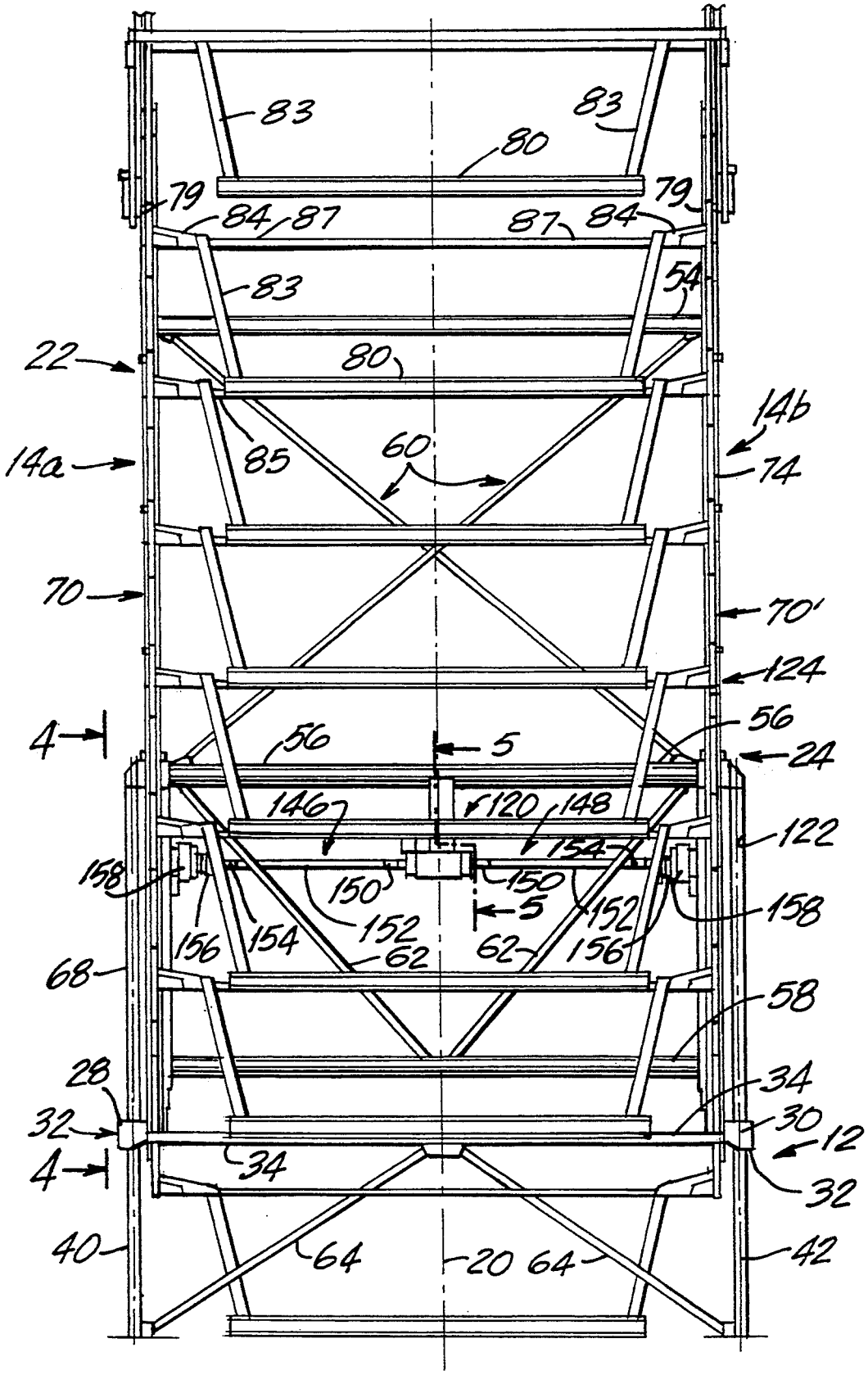
FIG. 2 is a side elevation view of the vertical conveyor shown in FIG. 1.

Referring now to FIGS. 1 and 2, a vertical conveyor 10 according to a presently preferred embodiment is depicted. The conveyor 10 has a skeletal frame 12. A compression chain vertical conveyor system 14 (FIG. 2) includes a left subsystem 14*a* and a substantially identical right subsystem 14*b*. A plurality of platform cells or pans 16 are hung from the conveyor system 14 and are rotated in either direction in an endless racetrack (looped) path.

The illustrated conveyor 10 has fourteen pans 16. Each pan 16 is designed to carry a static load of up to 5,000 pounds, and thus can carry a full size manufactured automobile. In this illustrated embodiment, the conveyor 10 has an overall height of about 52 feet, an overall width of about 20 feet, and an overall length of about 25 feet. The conveyor 10 can be designed to have more than thirty pans 16 and have a height of about 103 feet. The zoning laws in a particular location where the conveyor is installed will sometimes dictate height requirements.

Figure 18:
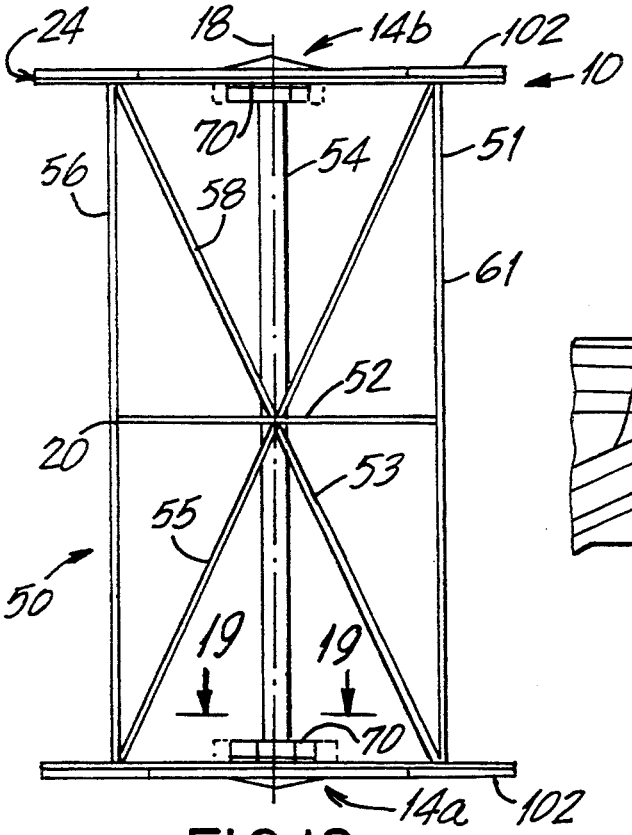
FIG. 18 is a top plan view of the conveyor shown in FIG. 1.

Frame 12 (FIGS. 1 and 2), is a fixed support structure and is substantially transversely symmetrical about a central plane 18 as depicted in FIG. 2 and is substantially longitudinally symmetrical about a central plane 20. A top guide strut brace 52 is at the top. As shown in FIGS. 2 and 18, the frame 12 includes a front vertical frame section 22 (shown in side elevation in FIG. 1) and a substantially identical rear vertical frame section 24 mounted on a rectangular base section 26.

The base section 26 has two transverse headers: 1) a front transverse header 28 and 2) a rear transverse header 30 connected at substantially similar top cornices 32 to two longitudinal side headers (not shown). The front, rear and side headers define an annular rectangle. The base section 26 also includes four legs (three shown) located at and connected to each cornice 32.

As shown in FIG. 2, the front header 28 has a rotated "G" shaped cross-section and rests above the automobile entrance. The "G" shaped cross-section forms a stronger, lighter and more economically manufactured member which can be easily installed and removed. In addition, other conveyor equipment can be mounted inside the G-shaped header frame including operating equipment for a gate (not shown) used to block the entrance to the conveyor 10.

Figure 17:
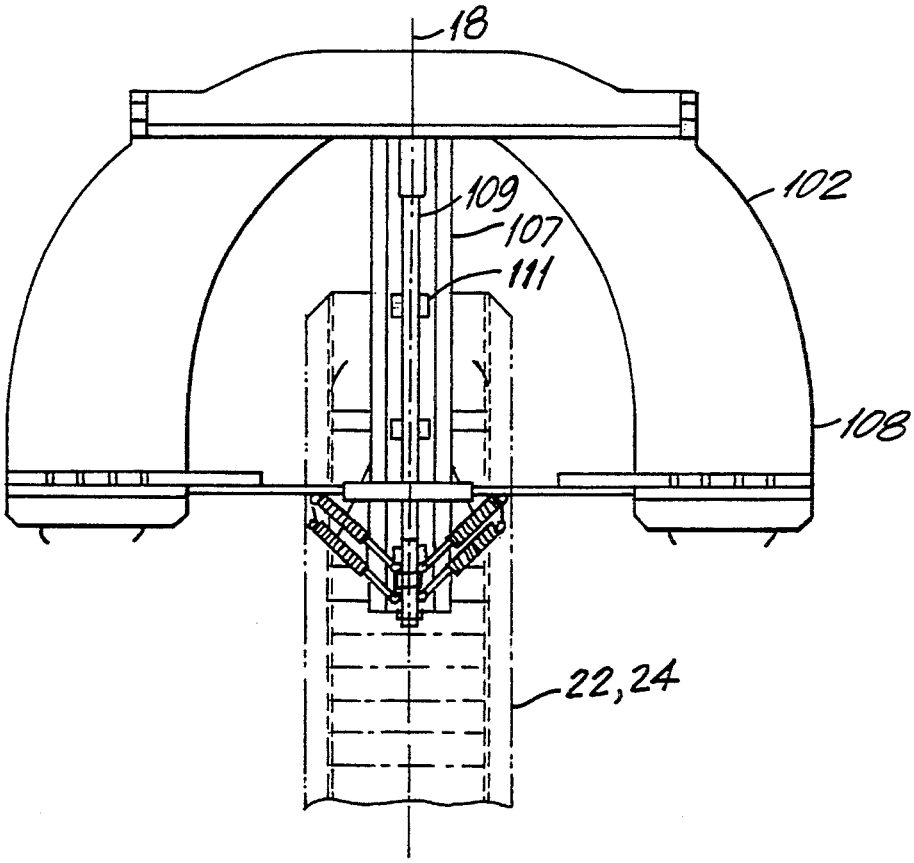
FIG. 17 is an enlarged, front elevation view of the top stabilizing transfer guide assembly.

As shown in FIG. 2, a plurality of internal braces on each side of the vertical conveyor 10 connect the frame sections 22 and 24 together and provide structural rigidity, equalizing the loading between the frame sections. The internal bracing includes horizontal struts 34, 54, 56, 58 (FIG. 2), each of which is rigidly mounted at respective ends to frame sections 22 and 24. Lateral stability is provided by diagonal bracing 60, 62 and 64. The bracing for the top transfer guide 102 FIGS. 1, 17, and 18 is shown in section 50 and includes a top guide strut brace 52, two top guide spacing struts 51 and 57, and four top guide braces 53, 55, 59 and 61 bolted together to form an "X" configuration.

As shown in FIG. 1, the frame section 22 has substantially the form of an A-frame. The frame section 22 has a base formed by header 28 and legs 38 and 40, and has an upper section formed by diagonal columns 66 and 68. The diagonal columns 66 and 68 are bolted at their lower ends to respective cornices 32 of the A-frame base, and are bolted at their upper ends to each other and to a transverse midpoint of front column 70.

A substantially similar rear column 70′ (FIG. 2) is provided for the frame section 24. The column 70 includes a lower section 72 and an upper section 74 that are spliced together with bolts at a vertical mid-portion joint 76 (described below). The height of the mid-portion joint 76 above the foundation 11 depends upon the total number of conveyor pans and the overall height of conveyor 10. The lower column section 72 includes a solid one-piece weldment.

Figure 14:
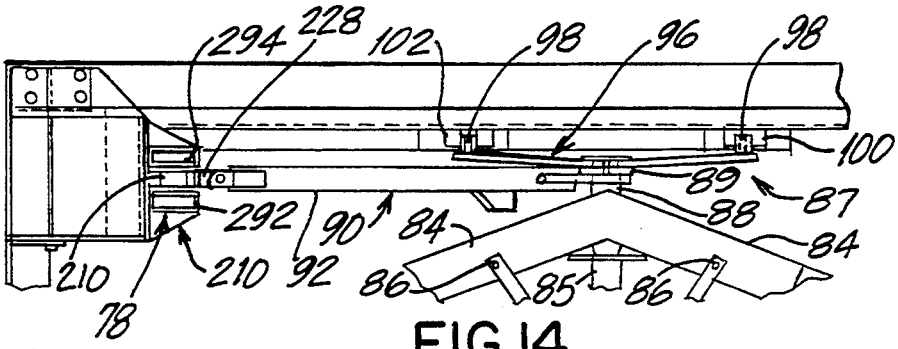
FIG. 14 is an enlarged plan view taken along line 14—14 of FIG. 1 depicting the mounting and stabilizing structures of one end of a conveyed pan.

The columns 70 and 70′ form a fixed tower structure and provide a conveyor housing and track for a secondary conveyor assembly that includes a rolling compression chain 78 (FIG. 14).

For the purposes of the description of the present invention, the detailed construction of compression chain 78 and of columns 70 and 70′ is not described in detail. Details of such construction can be obtained by referring to the aforementioned U.S. Pat. No. 3,656,608 to Lichti. Each column 70 and 70′ serves as part of a main frame extending upwardly from the front header 28 (or the rear header for rear frame section 24) through a joint adjacent the top of conveyor 10 where it supports the upper end of endless conveyor compression chain 78 located at the point where chain 78 crosses over from one side to the other.

Each platform pan 16 has a slightly, upwardly curved, rectangularly configured bottom plate 80. The bottom plate 80 is supported at each corner by a vertical pan hanger or post 83. Those posts 83 are located on the same side of the bottom plate 80 and connected at the tops thereof to a horizontal, V-shaped top pan header 84 (FIG. 14). A horizontal, tubular top strut 85 connects the apices of each header 84 and, with two braces 86, are welded thereto.

Referring to FIG. 14, each platform pan 16 is mounted and stabilized during its travel around conveyor 10 through a mounting assembly 87. A stub shaft 88 connects the mounting assembly 87 to the pan 16. The stub shaft 88 extends outwardly from the other side of the apex of each header 84 and is welded thereto. A bearing housing 89 is mounted on the stub shaft 83. The apex of a "v" shaped link hanger 90 is pivotally mounted to the bearing housing 89. The link hanger 90 has two coplanar arms (arm 92 shown in FIG. 14), which are pivotally mounted at their respective free ends to a compression link of the endless compression chain 78. Thus, a pan 16 is cantilever mounted at each end to the corresponding conveyor subsystem 14*a* or 14*b* by a link hanger 90.

Figure 19:
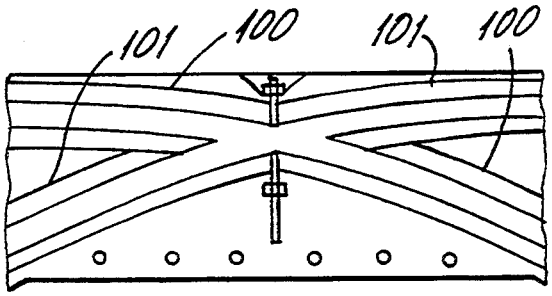
FIG. 19 is a partial rear elevation view taken along line 19—19 of FIG. 18 and showing the guide channel crossover.
Figure 22:
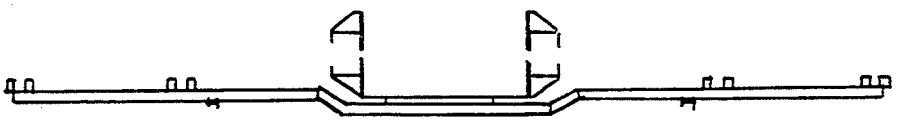
FIG. 22 is a top plan engineering scale view of the bottom stabilizing transfer guide assembly depicted in FIG. 20.

As shown in FIGS. 1 and 14, the apex of a V-shaped stabilizer 96 is also mounted to the stub shaft 88. The stabilizer 96 pivotally mounts guide shoes 98. The stabilizer 98 stabilizes the pan 16 as it is conveyed around the top and bottom of the conveyor 10. Mounted to the top and bottom of front and rear conveyor housings 70 and 72 are a top guide 102 and a bottom guide 104 which contain crossing channels 100 and 102 (see also FIG. 19). Guide shoes 98 of each pan 16 are received in the channels 100 and 101 as a pan 16 is conveyed.

In general, the vertical conveyor 10 includes a motor means 120, a pickup drive chain assembly 122 rotated by the motor, and a compression drive chain assembly 124, driven by the pickup drive chain assembly 122. The compression chain assembly 124 includes a compression chain 78 that carries pans 16.

In the present invention, the motor means includes a motor 130 which is a double ended, reversible, three phase 460 AC volt input, 500 volt DC output, regenerative electric motor. The motor is connected to the primary drive chain assembly 122 of each frame section 22 and 24 through drive subassemblies 146 and 148 (FIG. 2). Each drive subassembly 146 and 148 comprises a commercially available universal joint 150 which connects a drive shaft 152 to motor 130. A second, distal universal joint 154 is connected to the distal end of the drive shaft 152. Connected to the other end of the distal universal joint, through a keyed fitting (not shown) is a conventional, hydraulically actuated electrically operated friction brake 156, which is connected and mounted to a speed reduction gearing 158 with a splice fitting (not shown). The housing containing the reduction gearing 158 is mounted at the other end to the corresponding vertical frame section 22 or 24. The reduction gearing 158 is operatively connected to and drives the pickup drive chain assembly 122.

Referring now to FIGS. 1 through 5, each pickup drive chain assembly 122 is mounted on a solid, one piece weldment 160 which includes a lower frame section 72 of the frame portion 22. More particularly, the pickup drive chain assembly 122 is mounted inside an interior cavity 162 of the weldment 160.

Figure 4A:
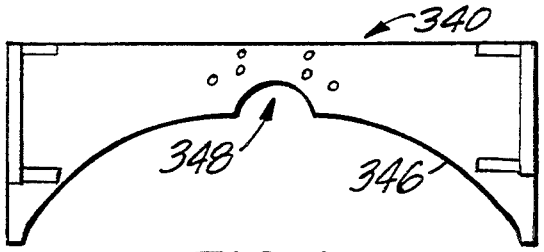
FIG. 4*a* is an enlarged, front elevation view of the front upper guide plate subassembly.
Figure 7:
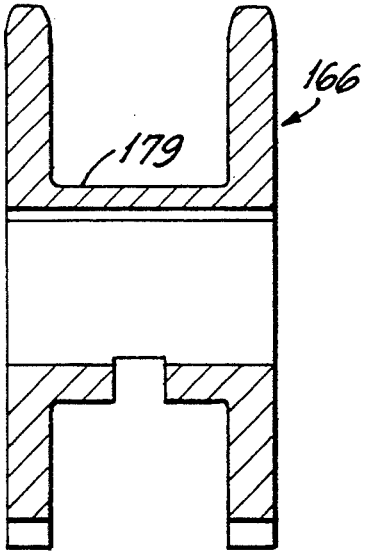
FIG. 7 is a cross-sectional view taken along line 7—7 of FIG. 6.
Figure 9:
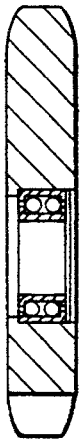
FIG. 9 is a cross-sectional view taken along line 9—9 of FIG. 8.
Figure 8:
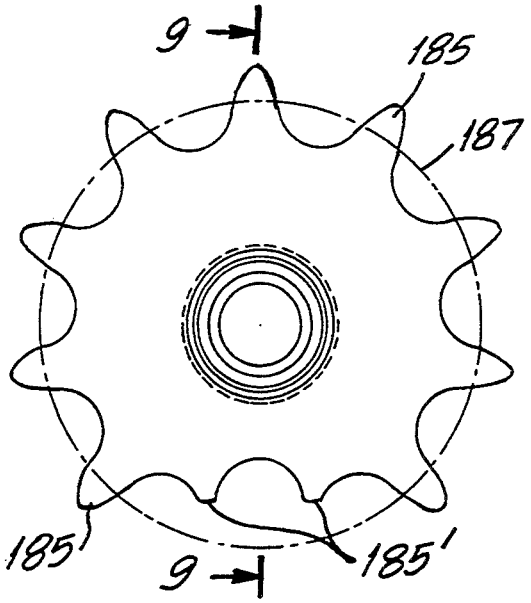
FIG. 8 is an enlarged engineering scale front elevation view of the idler sprocket.
Figure 10:
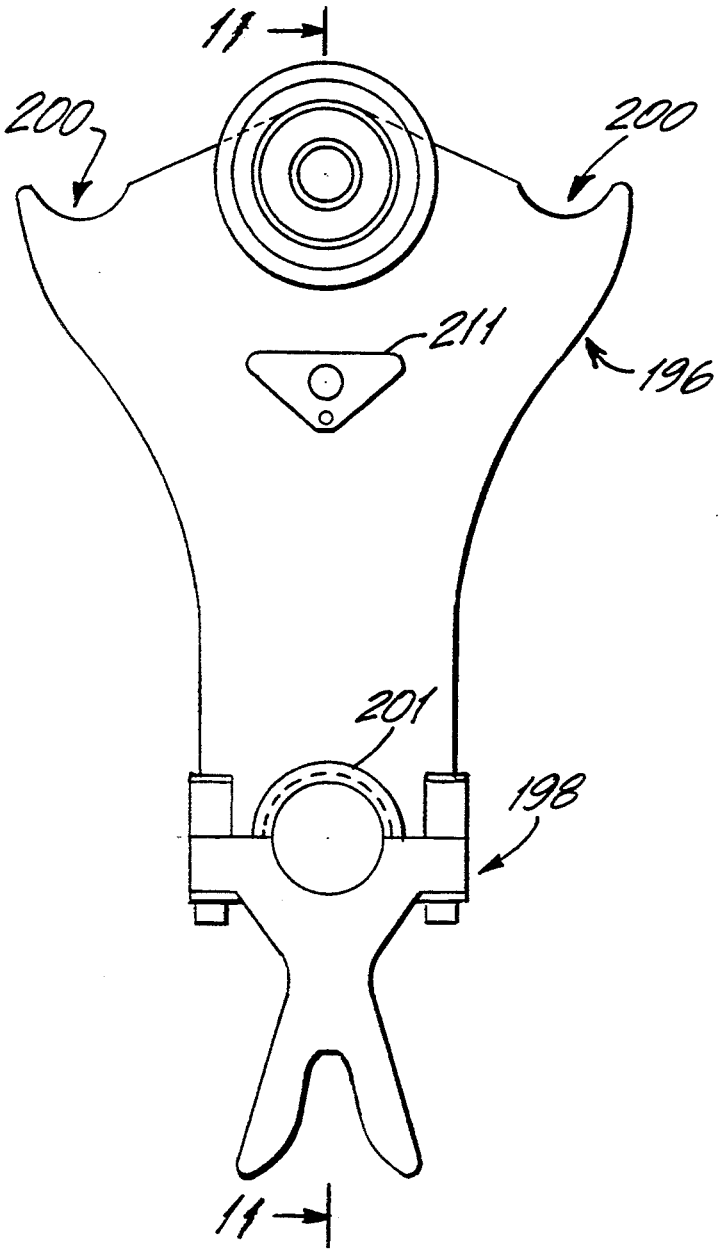
FIG. 10 is an enlarged front elevation view of one of the pickup arm assemblies which engages with and conveys a compression link in the secondary chain.
Figure 11:
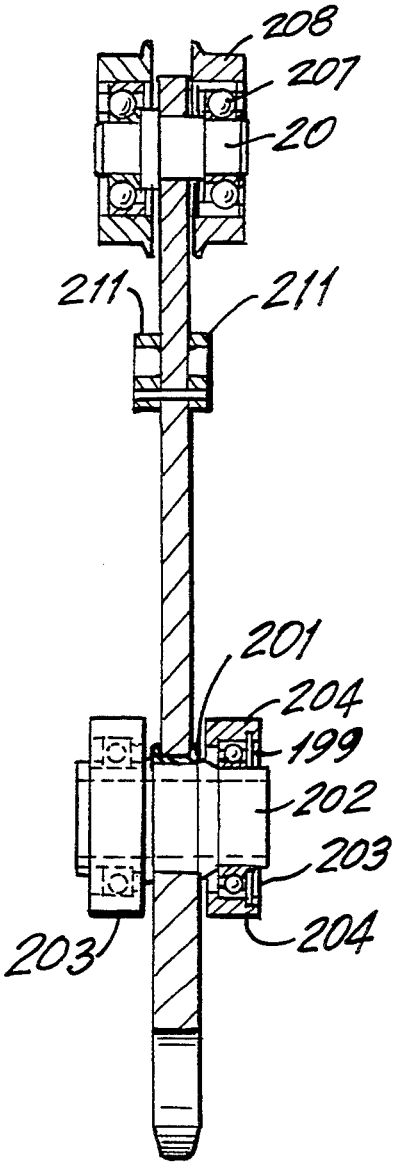
FIG. 11 is a sectional view taken along line 11—11 of FIG. 10.

The pickup drive chain assembly 122 (FIGS. 3 and 12) includes an upper toothed drive sprocket subassembly 166 (FIG. 7), a lower toothed idler sprocket subassembly 168 (FIG. 9), a dual drive chain subassembly 170 (FIG. 12A) and five pickups 172 (FIG. 10) attached to the drive chain subassembly 170 with a through-pin 194 (FIG. **12*a*) and rotated in a racetrack path. In the illustrated embodiment, there are only five pickups 172. For explanation and clarity, one of the pickups 172 is shown in phantom (FIG. 3) in an advanced position at the top of drive chain subassembly 170. In FIG. 4 the bottommost pickup 172** has been omitted.

Figure 6:
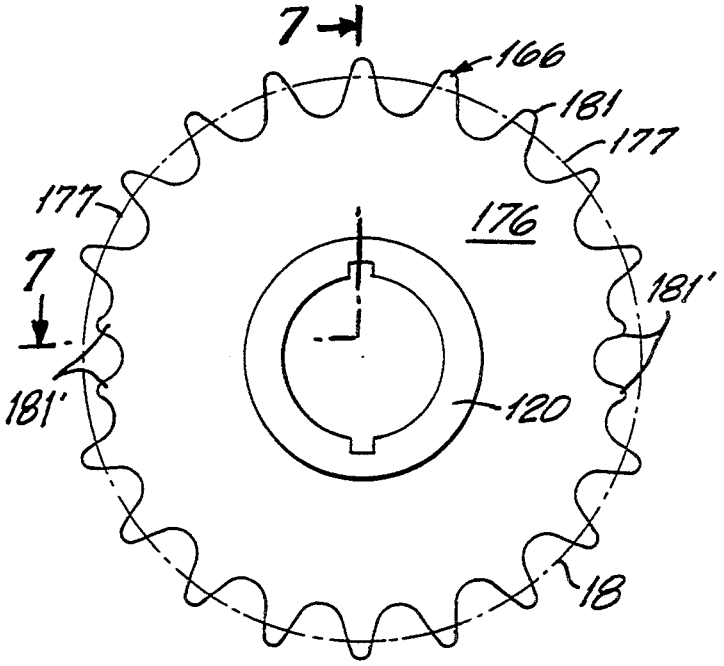
FIG. 6 is an enlarged front elevation view of the drive gear sprocket.

An upper toothed drive sprocket subassembly 166 is an integral, one-piece, molded element (FIGS. 6 and 7) and includes an outside drive sprocket 176, a substantially similar inside drive sprocket 178, and an interconnecting, hollow tube 179. A solid shaft 180 (FIG. 5) is keyed to and mounted inside the tube 179 and terminates on its inner end in a splice (not shown), which in turn is mounted to and driven by reduction gearing 158. The outer end of the shaft 180 is mounted in a bearing 183 (FIG. 5), which in turn is rigidly mounted to the weldment 160. Each drive sprocket 176 and 178 has a mean diameter of about 23 inches, a total of 18 standard teeth 181, and two sets of two reduced diameter teeth 181' located 180 degrees apart. The teeth 181' terminate inside the mean diameter circle 177. The radial size of the teeth is smaller so as to provide clearance for the diameter of the through-pin 194.

The lower toothed idler sprocket subassembly 168 is shown in FIGS. 4, 5, 8, 9, and 13 and includes an outside idler sprocket 184, a substantially similar inside idler sprocket (not shown), and coaxial, spaced apart shaft 188 for respectively mounting inside and outside idler sprockets. The 186 spacing between the adjacent ends of shafts 188 is selected so that pickups 172 can pass therebetween. Idler sprocket 184 has a diameter of about 12¼ inches and a total of nine teeth 185 and two teeth 185'. The teeth 185' terminate inside the mean diameter circle 187 and the pitch between them is deeper so as to provide clearance for the larger diameter of the through-pin 194.

Figure 12:
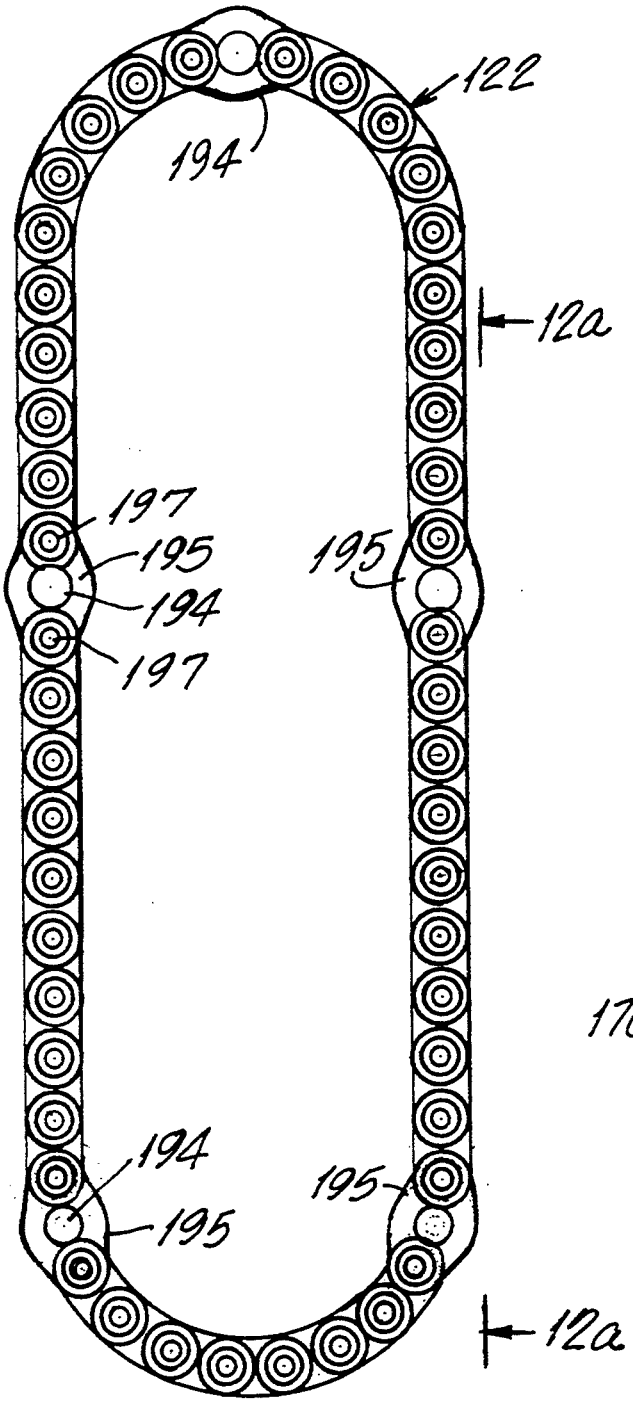
FIG. 12 is a front elevation view of the double-stranded conveyor chain in the pickup drive chain.
Figure 12A:
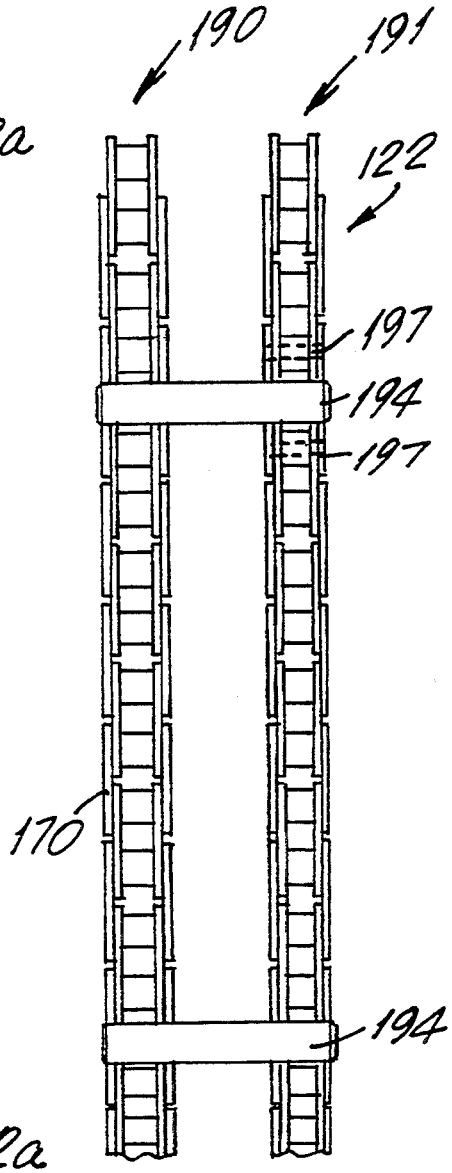
FIG. 12*a* is a sectional view of the pickup chain taken along line 12*a*—12*a* of FIG. 12.

The pickup drive chain subassembly 122 (FIGS. 12 and **12*a*) is comprised of a first roller chain 190 and a second roller chain 192 each with five interconnected, matched strands. The center lines of the roller chains 190 and 192 are spaced apart about 8½ inches and the two chains are interconnected with five through-pins 194. Each of the five strands of each chain 190 and 192 is about 34¼ inches long and terminates in a master link 195 which connects to the adjacent strand and which mounts through-pin 194. In this particular embodiment, each chain 190 and 192 has an average tensile strength of 150,000 pounds per strand. The center axis line of the through-pins 194 is offset from a center line drawn from chain link-pins 197 (FIG. 12**).

As shown in FIGS. 3, 4, 11 12 and **12*a* a pickup 172 is pivotally mounted at the bottom section thereof on each heat-treated through-pin 194**.

The pickups 172 of the present invention have a split body. Each pickup 172 includes an upper head portion 196 and a smaller, lower bifurcated tail portion 198 that is mounted to upper head portion with bolts and nuts (not shown). In a preferred embodiment, pickup 172 is almost 26 inches long and a little over 14 inches wide at the top and tapers down to 7 inches wide at the bottom of head portion 196 with a 10 inch radius curve. Each pickup 172 is journalled onto the through-pin 194 and is held centered thereon with snap rings 199 on either side. A notch 200 (FIG. 10) on each side of the centerline of pickup 172 in the upper head portion 196 engages with and picks up a connecting pin assembly, shown at 210 (FIG. 3), in compression chain 78 (FIG. 14).

The mating ends of the head portion 196 and tail portion are provided with mating half-circular cutouts. The cutout in the head portion 196 has a nominal radius of 1.5 inches so it can receive a semi-circular bearing insert 201 having integral end flanges. The cutout in the tail portion 198 has a nominal radius of 1.25 inches, which matches with the inner surface of insert 201. A sleeve 202 has a thickened central portion with a central circular slot therein for engaging the head portion. The sleeve 202 has a reduced shoulder to support ball bearings 203 at each end. Each ball bearing supports 203 a metal wheel 204, which has been heat treated to a surface hardness of Rc 44/47. The wheels 203 have an outer diameter of 4.625 inches in a preferred embodiment and engage and ride on a bottom guard 205 (see FIG. 4), which helps orient the pickup 172.

Located near the top of head portion 196 (FIG. 10) is a hole having a radius of 1¾ inches for mounting a upper shaft 206. Mounted onto each end of shaft 206 (FIG. 11) are ball bearings 207 which in turn mount a top, inner flanged wheel 208, which has an base outer diameter of 4.5 inches and a flange outer diameter of 5.25 inches in a preferred embodiment. Wheel 208 engages and is guided by a plurality of track guides 209 (FIG. 4) and 352 (FIG. 4). Mounted between upper wheel 208 and lower wheel 204 on either side of pickup 172 is a somewhat triangular safety lug 211 (FIG. 10) which restricts the back fall of the pickup traversing the top guide 350 (FIG. 4).

Figure 3:
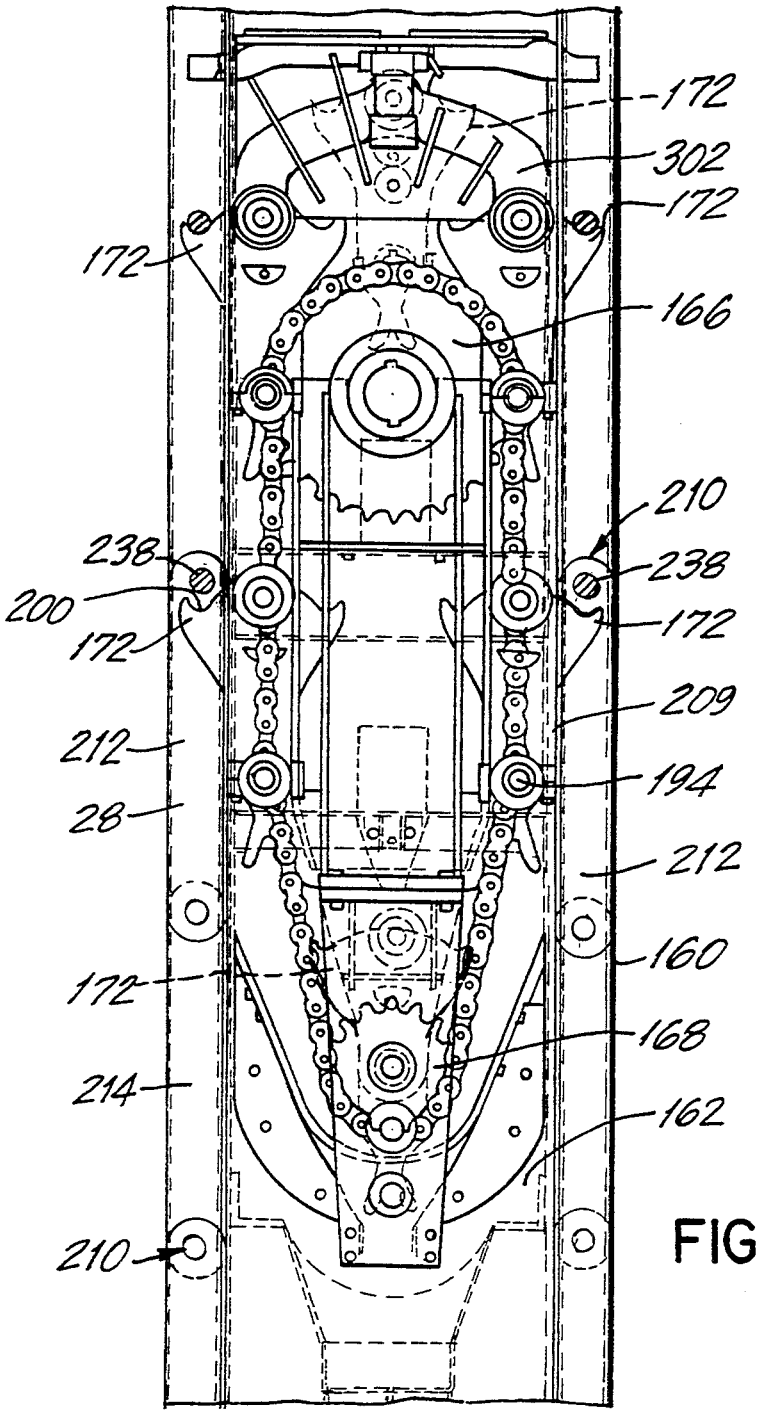
FIG. 3 is an enlarged, front elevational view of the major weldment of the frame and depicting the pickup drive chain mechanism for the vertical conveyor.
Figure 4:
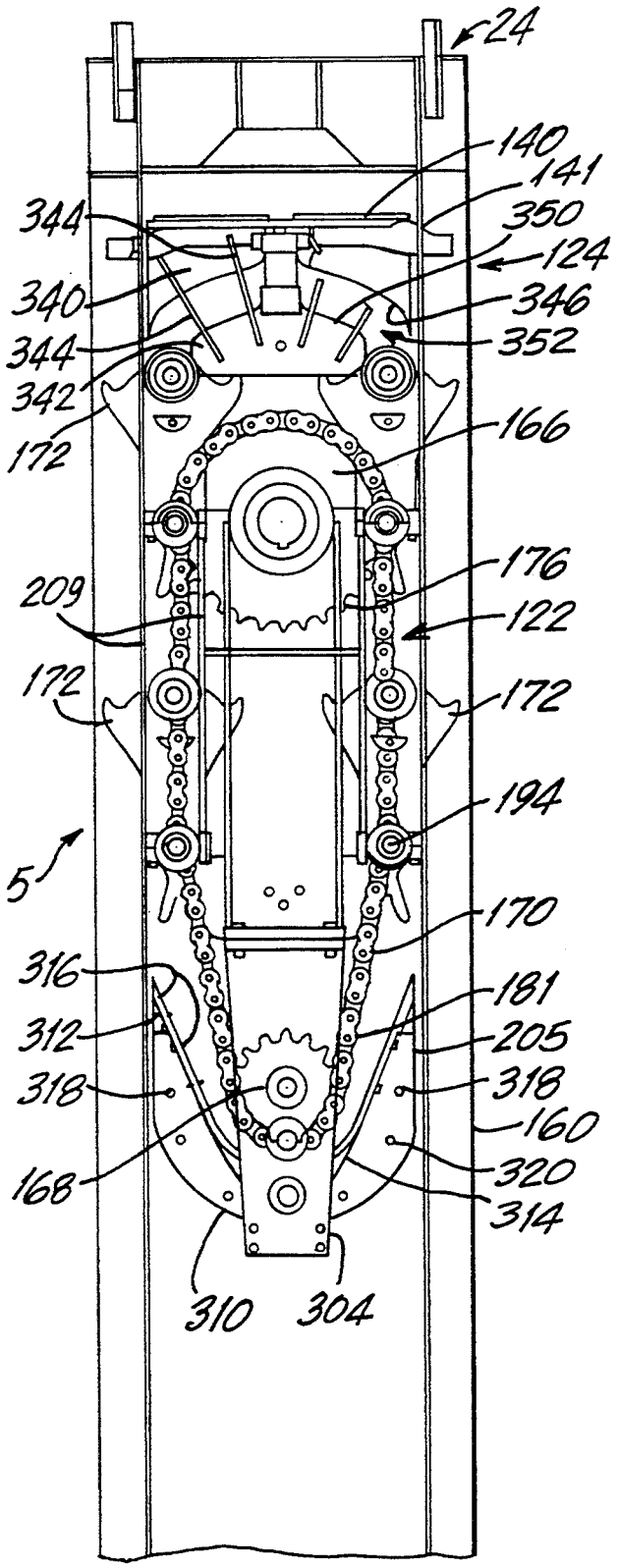
FIG. 4 is an enlarged front elevational view similar to FIG. 3, showing features of the endless pickup chain drive and of the secondary compression chain lock.
Figure 5:
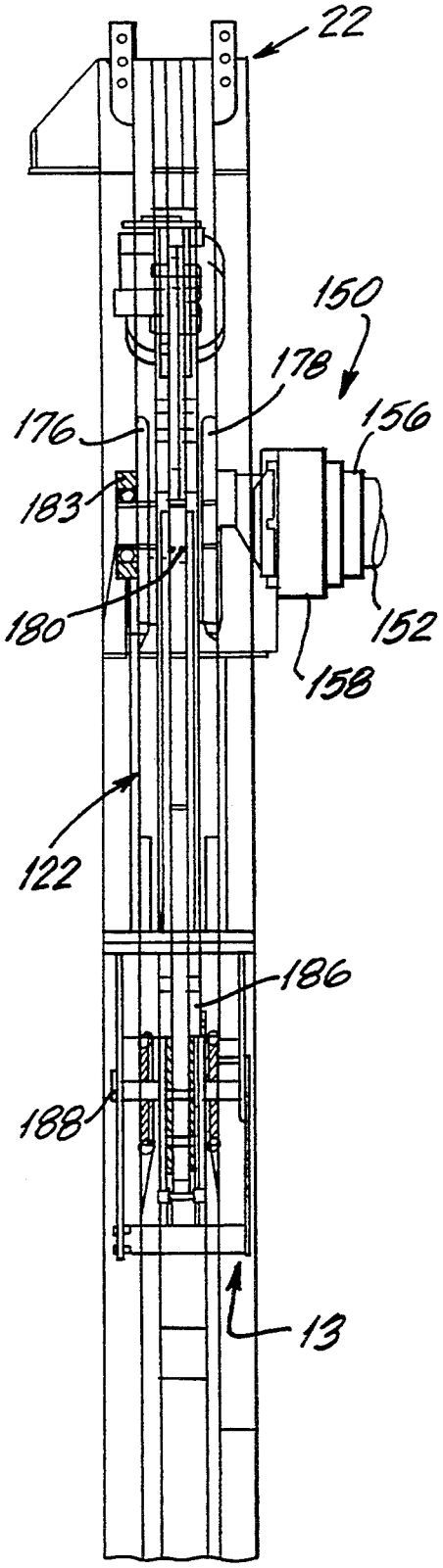
FIG. 5 is an enlarged side elevation view looking in the direction of arrow 4 of FIG. 4.

As shown in FIGS. 3 and 14, the compression chain 78 includes a plurality of outer compression links 212 and a plurality of inner compression links 214, which are similar to and fit inside outer compression links 212. The inner and outer compression links are pivotally interconnected by connecting pin assemblies 210. Also mounted to the inner link 214 are two angled connecting lugs 228, only one of which is depicted in FIG. 14, for connecting link hanger arms 91 and 92 of the pan 16.

As shown in FIG. 3, the bearing roller 238 is engaged in one of the notches 200 of the pickups 172 as the engaging pickup 172 lifts or pushes it and the associated compression link upwards. Thus the weight of the whole load on the side of the upwardly rotated conveyor 10 is realized through bearing roller 238.

Figure 15:
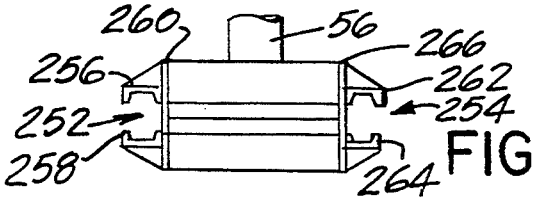
FIG. 15 is a sectional view of the upper column section taken along line 15—15 of FIG. 1.

The guide and channel subassemblies for the compression chain assembly 124 (FIG. 2) are integral components with the other elements of the conveyor 10. For the upper frame section 74 (FIGS. 1 and 15), the outwardmost components have spaced apart left hand guide rails 252 and right hand guide rails 254 (FIG. 15). The guide rails 252 include an inner guide channel 256 and an outer guide channel 258 spaced apart to the plate 260. The guide rails 254 are formed of an inner guide channel 262 and an outer channel 264 spaced apart to a plate 266. Each guide channel also serves as a vertical structural component and has a bevelled U-shaped channel that is welded to the upper frame section 74. The compression chain rollers 242 (FIG. 14) have a similar size, shape and bevel to the slope of the guide channels. The upper and lower ends of channels 252 and 254 are flared inwardly to permit the compression links 214 to "bend over" the top of frame sections 74 (FIG. 1) and 74*a* (FIG. 2).

Figure 16:
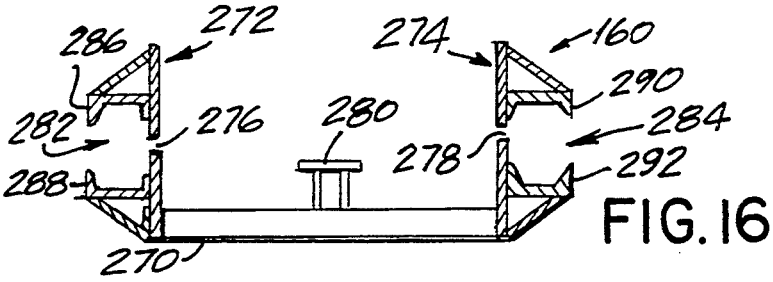
FIG. 16 is a sectional view of the lower column section taken along line 16—16 of FIG. 1.

The guide and channel subassemblies for the lower tower section are parts of the weldment 160 (shown in FIGS. 3, 4, 5 and 16). As shown in FIG. 16, the weldment 160 is formed of a welded metal sheet base plate 270 having side plates 272 and 274 welded to each end to form a somewhat rectangular box. In the middle section of side plates 272 and 274 are slots 276 and 278 to accommodate pickups 172 entering the channel area and engaging connecting pin 210 of compression chain 78. The weldment, 160, as shown in FIG. 16, also contains suitable mounting plates, such as mounting plate 280, for mounting the pickup dive chain assembly 122.

Directly welded to side plate 272 is a guide rail 282. A guide rail 284 is welded to side plate 274. The guide rail 282 has an inner guide channel 286 (FIG. 16) and an outer guide channel 288 spaced apart and connected to side plate 274 by welding. Similarly, the guide rail 284 has an inner guide channel 290 and an outer channel 290 mounted spaced apart and connected to side plate 274 by welding. Each guide channel 286, 288, 290 and 292 also serves as vertical structural component and is a bevelled U-shaped channel that is connected to weldment 160. Also, each U-shaped channel has the same size and shape as channels 256, 258, 262 and 264.

Figure 13:
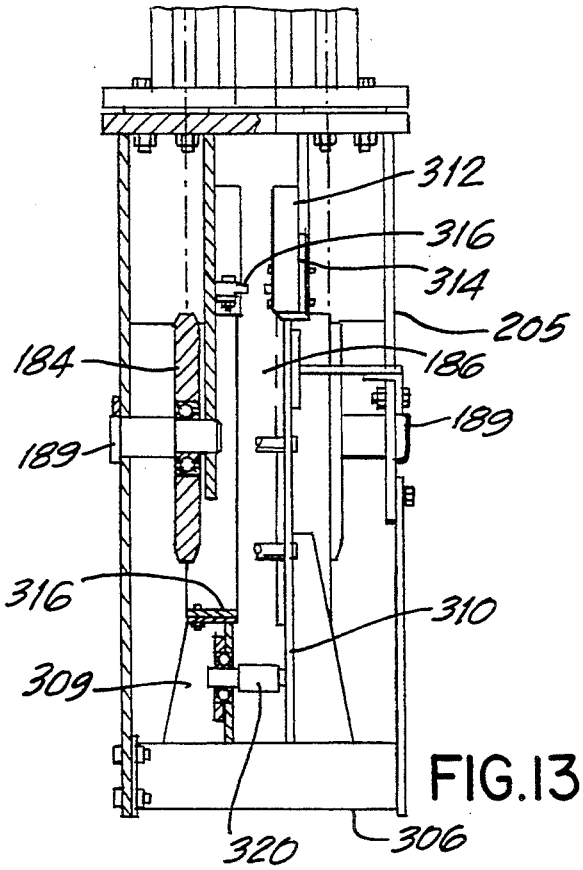
FIG. 13 is an enlarged side elevation view of the bottom pickup guide assembly.

The weldment 160 (FIGS. 3, 4 and 5) has three pickup guides—the bottom guide 205, side guide 209, and a top guide 302. The bottom guide 205 is also shown in FIG. 13 and has a mounting plate 304 rigidly attached at the bottom to a square mounting tube 306. Two substantially identical spaced guides 308 and 309 (not shown) are rigidly mounted at their respective bottoms to the mounting tube 306. Each guide 308 and 309 is comprised of a U-shaped guide plate 310 (FIG. 4) with removably mounted tip portions 312 bolted thereto and supporting side gusset plates 314. A flat polyurethane guide bar 316 is mounted perpendicularly along the inner edge of guide plate 310 (FIG. 4). The pivot pin 320 also catches the tail portion of the pickup 172 as the pickup 172 is rotated in either direction to it. This holds the bottom of the pickup 172 stationary, and permits the top portion, connected to chains 190 and 192, to be rotated with respect to the bottom in the proper direction.

The side guides 209 have an outer guide plate 326 which extends out of the paper (FIG. 3) and an inner guide plate 328 which is bolted to the primary drive mounting plate 272 and 274 (FIG. 16).

The top guide 302 (FIG. 3) has a front upper guide plate 340 rigidly mounted on the weldment 160 and a lower guide plate 342 spaced below the upper guide plate 340. A similarly shaped rear upper guide (not shown) is spaced 2½ inches behind the front guide. Together the front and rear guides form a captive path 352 for the upper wheel 208 of a pickup 196 to traverse the top of the drive. A plurality of U-shaped jointing plates 344 are perpendicular to the plates 340 and 342 and welded at its respective feet to plates 340 and 342. As seen in FIG. 4*a*, the upper guide plate 340 has a lower concave curvilinear surface 346 with a circular upper mid-portion cutout 348 which is symmetrical about the centerline. The curvilinear surface 346 has a preferred lower circular segment with a 4.75 inch radius and an upper circular segment with a 39.75 inch radius. The cutout 348 has a 2.25 inch radius. The bottom length of upper guide plate is 27.5 inches. The lower guide plate 346 has a pentagon shape with an upper convex curvilinear surface 350 that is symmetrical about the centerline. Each half of surface 350 has a circular segment to produce a guide path 352 (FIG. 4).

As upper wheel 208 of pickup 172 enters either end of guide path 352, it will cause pickup 172 to rotate slightly in the direction of motion. When pickup upper wheel 288 enters cutout 348, the top of pickup 172 is prevented from rotating and the pickup tail will then rotate in the direction through the center of the drive. In this way, pickup 172 is rotated into preferred orientation to exit the top guide path.

Figure 24:
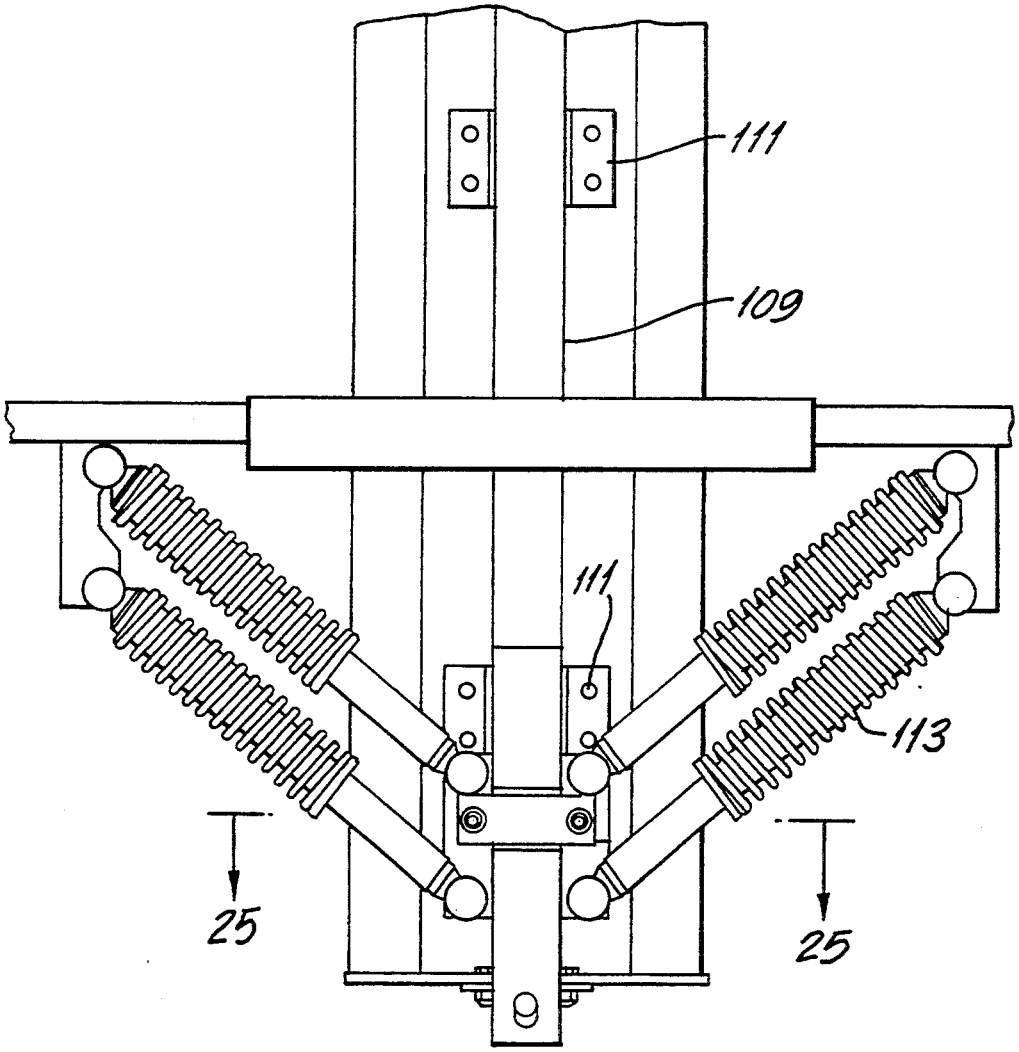
FIG. 24 is an enlarged, front elevation of the circled portion of FIG. 17 to delineate the shock mechanism.
Figure 25A:
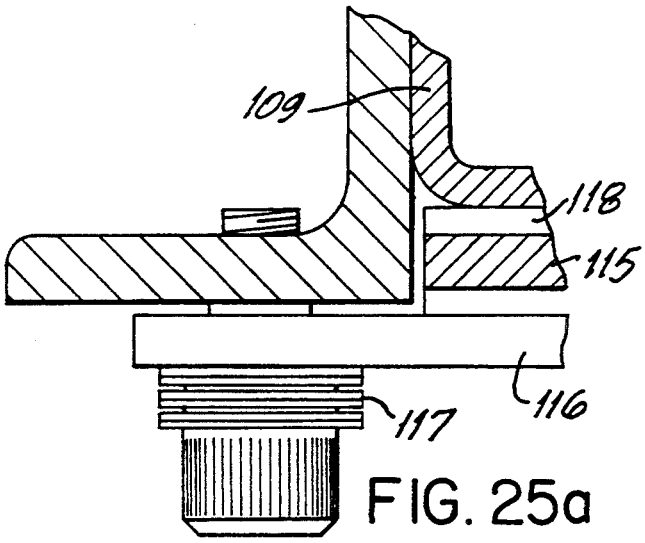
FIG. 25*a* is an enlarged section view of FIG. 25*a* delineating the friction mechanism components of the top transfer guide.
Figure 25:
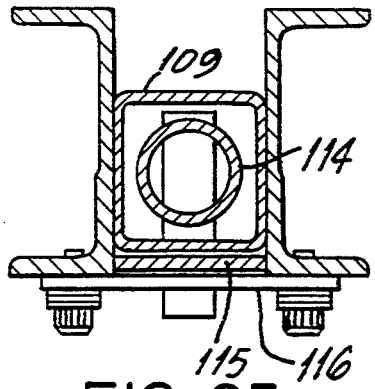
FIG. 25 is an enlarged section view of the sliding guide for the top transfer guide shown in FIG. 24.

Referring now to FIGS. 24, 25 and 25*a*, details of the dampening action imparted to the apparatus is described together with an improved locking device.

As a pan 16 (FIG. 1) traverses the top of the conveyor 10, the shoes 98 (FIG. 1) are engaged in the tracks 100 and 101 (FIG. 19) of the top transfer guide 102 (FIG. 1) and lift the transfer guide upward at the apex of the travel and then returns as the shoes pass from the apex of travel. The top transfer guide 102 (FIG. 17) is comprised of the sliding guide support 107 and transfer guide 108. The center tube 109 of the sliding guide 107 is bolted 111 to the fixed tower 22. In FIG. 24 the vertical weight of the transfer is counter balanced by the four shock absorbers 113 which also provide a dampening motion for the guide movement. Inside the center tube 109 is a ground tube 114 (FIG. 25) that provides a vertical guide for the sliding guide 107. At the bottom end of the round tube 114 is round bar that engages a friction bar 115 and is restrained by a captive bar 116. Bellville washers 117 provide friction between a friction plate 118 and the captive bar 116. The friction connection is then established between the fixed tower 22 and the sliding guide 107 and still allow a downward movement of the transfer guide as the compression chain shortens during the life of the conveyor.

Figure 20:
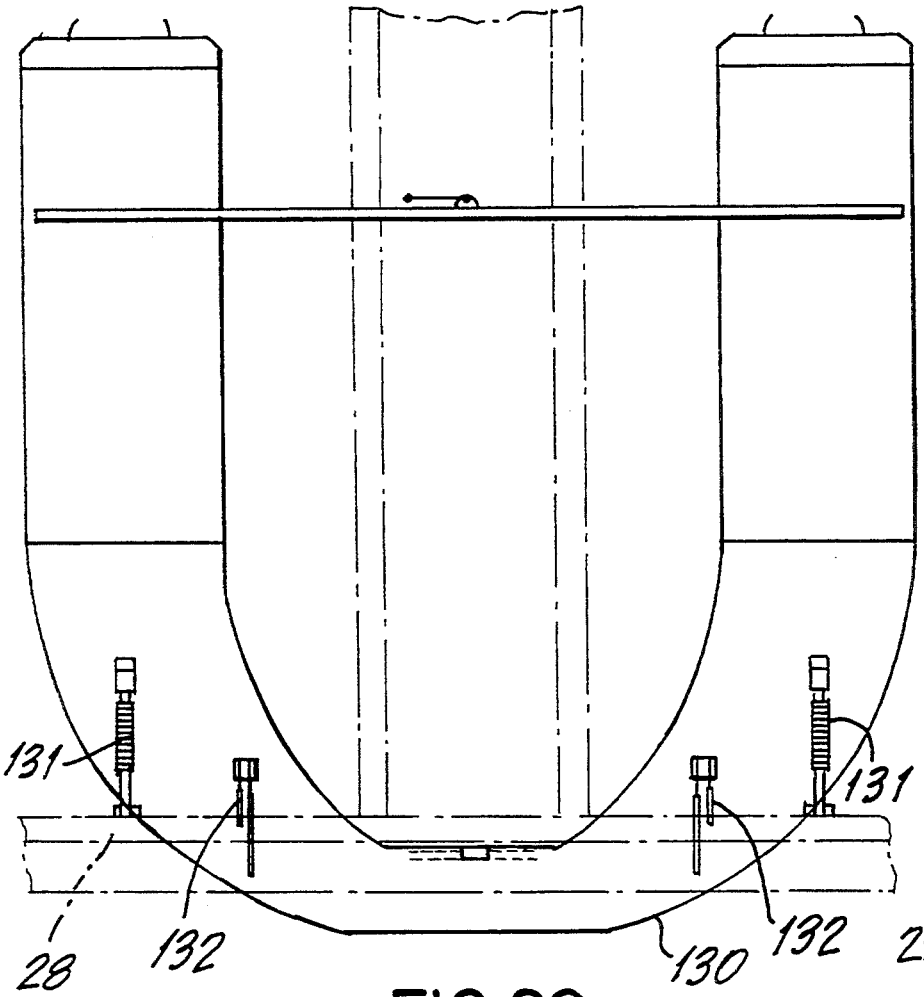
FIG. 20 is an enlarged, front elevation view of the bottom stabilizing transfer guide assembly.
Figure 21:
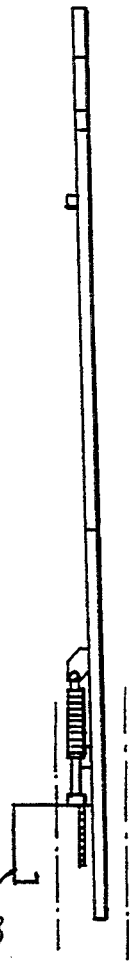
FIG. 21 is a side elevation of the bottom stabilizing transfer guide assembly shown in FIG. 20.

The bottom transfer guide 130 floats down and up as a pan 16 (FIG. 1) traverses the bottom of the conveyor 10 (FIG. 1). The vertical weight of the bottom transfer guide 130 is transferred through the two shock absorbers 131 (FIG. 20) and two die springs 132 (FIG. 20) to the header 28. The shock absorbers 131 provide the dampening of the vertical motion of the bottom transfer guide 130. The upward motion of the guide 130 is restricted by die spring 133 and is mounted such that it comes in contact with the under side of header 28 (FIG. 1) during excessive upward movements. This series of die springs and shock absorbers keep the bottom transfer guide at a prescribed reference point and still allow vertical motion with a dampening effect.

Figure 23:
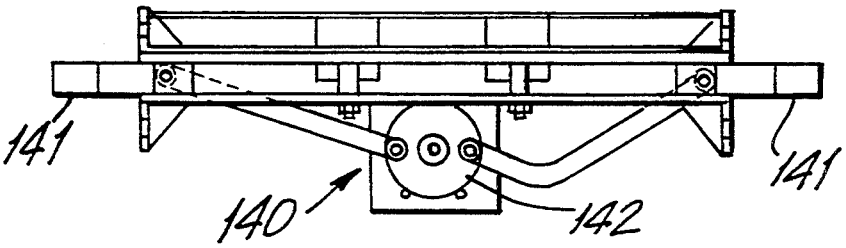
FIG. 23 is an enlarged, top plan view of the tower locking assembly.

When a pan 16 (FIG. 1) is at the bottom of the conveyor 10 the lock link system 140 (FIG. 4 and 23) is in its extended position. The height of the lock link bar 141 (FIG. 4) is such that the top of the bar 141 is $\frac{1}{8}$ (0.125) of an inch below a bearing roller 238 (FIG. 3) of a compression link. Normally a service brake 156 (FIG. 2) provides the holding power to resist any unbalanced load. If one or both of these brakes 156 fail then the compression chain 78 could move in the direction of the unbalanced load. The lock link bars 141 are extended and retracted by the cam motion of the actuator 143 (FIG. 23). In FIG. 23 the lock link bars 141 are shown extended to engage the compression chain. When the bar 141 is rotated clockwise 180 degrees, the lock link bar will retract and allow the compression chain 78 to move.

It should be understood that the foregoing description of the invention is intended merely to be illustrative thereof, and that other embodiments, modifications, and equivalents may be apparent to those skilled in the art without departing from its spirit.

That which is claimed is:

1. A vertical conveyor comprising:

a frame having a first vertical frame section and a second vertical frame section spaced apart from, and means connecting said frame sections together, a plurality of load supports, each support having a first and second and capable of holding a load to be conveyed around in a looped path, each support being movably mounted at the first and second ends respectively to the first and second frame sections such that as one support is being conveyed downwardly so that the supports pass one another at a predetermined spaced apart horizontal distance which defines a support spacing, first and second conveying means mounted respectively to said first and second frame sections for respectively conveying a first and second end of said supports, wherein said first and second conveying means each comprises a looped compression chain supporting said supports, a pickup drive chain comprising at least two strands and through-pins interconnecting the matched strands, a plurality of pickup arms pivotally connected to said through-pins such that said pickup arms engage and drive said compression chain, said pickup arms comprising a two-piece substantially planar body having an upper head portion and lower tail portion, each portion having cut outs at mating ends to form an opening through which a respective through-pin is received, said upper head portion and lower tail portion being removably mated to each other so as to enable ready disassembly of the pickup arms from the pickup drive chain, and motor means for simultaneously driving said first and second pickup drive chains so that said pickup arms engage and drive said compression chain so as to move said load supports.

2. The vertical conveyor according to claim 1 wherein said first and second conveying means comprises a compression chain assembly which supports said load supports, and a plurality of pickup arms pivotally connected to said pickup drive chain such that said pickup arms engage and drive said compression chain so as to move said load supports.

3. The vertical conveyor according to claim 2 wherein said pickups are pivotally mounted offset on said pickup drive chain to aid in engagement of said pickups with said compression chain.

4. The vertical conveyor according to claim 2 wherein said compression chain assembly includes an endless roller chain comprised of interconnecting, elongate compression links and transverse axles mounted at each end of said compression links such that said pickup arms engage said axles for pushing said compression links upward.

5. The vertical conveyor according to claim 4 wherein said load supports include load support mounting arms, and means pivotally mounting said load support mounting arms to said compression links.

6. The vertical conveyor according to claim 1 including a mounting member extending in said support spacing, wherein said motor means is mounted to said mounting member, and including a connecting member supportingly connecting said first and second frame sections, and wherein said motor mounting member is suspended from said one connecting member substantially centrally between said frame members.

7. The conveyor according to claim 1 wherein the pickup drive chain comprises two spaced roller chains, each through-pin interconnecting said roller chains, wherein said pickups are pivotally connected to said roller chain between said pickups.

8. The conveyor according to claim 1 wherein said pickup drive chain includes a link, and a link pin interconnecting said links, and wherein said through-pins are offset from said link pins.

9. The conveyor according to claim 1 wherein said pickups comprise an upper head portion and a smaller, lower bifurcated tail portion.

10. The conveyor according to claim 9 wherein the upper head portion includes two receiving notches for receiving therein respective through-pins on said compression chain.

* * * * *